United States Patent [19]

Capps et al.

[11] 4,283,364

[45] Aug. 11, 1981

[54] MELT SPINNING OF SYNTHETIC YARNS

[75] Inventors: Spencer W. Capps; Gerald E. Hagler; Agaram S. Abhiraman, all of Asheville, N.C.

[73] Assignee: Akzona Incorporated, Asheville, N.C.

[21] Appl. No.: 971,635

[22] Filed: Dec. 20, 1978

Related U.S. Application Data

[62] Division of Ser. No. 793,504, May 4, 1977, Pat. No. 4,153,409.

[51] Int. Cl.[3] ..... D01D 5/08

[52] U.S. Cl. ..... 264/176 F; 264/177 F; 264/237

[58] Field of Search ..... 425/464, 72 S; 264/176 F, 237, 177 F; 65/2, 12

[56] References Cited

U.S. PATENT DOCUMENTS

| | | | |
|---|---|---|---|
| 2,273,105 | 2/1942 | Heckert | 264/177 F |
| 2,553,692 | 5/1951 | Webb | 425/464 |
| 2,740,986 | 4/1956 | Lipscomb et al. | 425/464 |
| 2,965,924 | 12/1960 | Hull | 425/464 |
| 3,057,009 | 10/1962 | Lipski | 425/464 |
| 3,100,675 | 8/1963 | Westerhuis et al. | 425/464 |
| 3,293,696 | 12/1966 | Bruni | 425/464 |
| 3,335,210 | 8/1967 | Vinicki | 425/464 |
| 3,681,910 | 8/1972 | Reese | 264/103 |
| 3,982,915 | 9/1976 | Coggin | 65/12 |
| 4,033,742 | 7/1977 | Nichols et al. | 65/2 |
| 4,197,103 | 4/1980 | Ishikawa et al. | 65/12 |

FOREIGN PATENT DOCUMENTS

| | | | |
|---|---|---|---|
| 47-8764 | 3/1972 | Japan | 425/464 |
| 51-7218 | 1/1976 | Japan | 264/237 |
| 51-3807 | 2/1976 | Japan | 264/103 |
| 756478 | 9/1956 | United Kingdom | 425/464 |

*Primary Examiner*—Jay H. Woo

*Attorney, Agent, or Firm*—Craig and Antonelli

[57] ABSTRACT

An apparatus for melt spinning of polymers into synthetic yarns having greater bundle uniformity has a spinning assembly for extruding molten polymers through orifices in a spinning plate to form filaments and a blow box for directing cooling gas transversely across and through the filaments that extend vertically downwardly from the spinning plates. The spinning plate is provided with at least two groups of orifices and the groups are arranged to provide one or more open lanes or channels that extend across the plate in a direction parallel to the direction of flow of the cooling gas. This lane has a width greater than the distance between adjacent orifices.

15 Claims, 10 Drawing Figures

MELT SPINNING OF SYNTHETIC YARNS

This is a division of application Ser. No. 793,504, filed May 4, 1977 now U.S. Pat. No. 4,153,409.

This invention relates to an improved apparatus and process for the manufacture of synthetic yarns by melt spinning and, in particular, to an apparatus for melt spinning of multi-filament yarns having a spinneret with orifices arranged in a pattern that produces yarns of low denier per filament count having highly uniform deniers and the process for producing such yarns with this apparatus.

During the production of synthetic yarns from polymeric materials such as the polyesters and nylons by melt spinning, it is conventional to extrude the polymeric material downwardly through a spinneret plate and to cool the resulting filaments by passing air transversely to the direction of the travel of the filaments exiting from the spinneret. Also, it has been proposed to arrange the spinning orifices in the spinneret in a pattern or configuration to reduce variations in the cooling rate of the filaments.

Generally, these earlier attempts to improve the uniformity in the cooling of the initially formed filaments involve the use of a relatively small number of spinning orifices in a particular configuration in the spinneret plate or the use of a spinneret plate which is relatively large so as to provide a greater spacing between adjacent spinning orifices which consequently provides a greater space between the individual filaments, and thus promotes more uniform cooling of the filaments as the air or other gas is transversely passed through the bundle of filaments exiting from the spinneret.

For example, U.S. Pat. No. 3,335,210 discloses a method for spinning filament yarns wherein a plurality of filaments is extruded through a spinneret plate having openings arranged in a "V" configuration, the "V" formation of filaments is passed through a quench region and a stream of air is directed under pressure at an angle perpendicular to the filaments and into the mouth of the "V" in the quench region so that the filaments produce a funneling of the air stream towards the apex of the "V" formation.

U.S. Pat. No. 2,969,561 describes a spinneret pack assembly having a spinneret plate with at least forty orifices arranged in a substantially rectangular pattern with a length of at least three times its width. The orifices are staggered in the direction of the width, and are in relatively long rows that are spaced relatively far apart. The orifices are spaced at least 0.15 inches apart.

The patent to Kruny (U.S. Pat. No. 3,296,696) discloses another spinneret for melt-spinning synthetic polymers wherein the orifices in the spinneret are arranged in two converging rows which include an angle therebetween with the distance between any two adjacent orifices in either of the rows being such that the projections of the centers of these two orifices to a line perpendicular to the direction of an air stream passing transversely to the filaments is at least 1 millimeter, and the rows are so disposed that a line bisecting the angle is parallel to the direction of the stream.

Another pattern for facilitating the production of synthetic filaments is shown in U.S. Pat. No. 3,100,675. The spinning orifices in the spinning plate disclosed in this patent are arranged in rows parallel to each other, and in a straight line in each row. The distance between the orifices are equal in all rows and usually at least about 5.5 millimeter. As shown in FIG. 4 of this patent the gaseous cooling medium flows parallel to the rows of orifices as indicated by the arrow.

In each of the spinning devices shown in these patents, a relatively small number of spinning orifices are provided per unit area of the spinneret, and consequently the air stream has little difficulty in uniformly cooling the filaments extruded through the orifices.

However, it has been found that during the production of synthetic yarns, such as polyester yarns, having a denier of 150 and consisting of 96 filaments, that a very high unevenness, i.e. denier non-uniformity, occurs with a spinneret having a cluster pattern conventionally used in the spinning of yarns. Such a conventional pattern is illustrated in FIG. 9 of the patent to Viniki.

In accordance with this invention an apparatus is provided which overcomes the disadvantages of the prior art and which ensures a much more uniform denier of the bundle of filaments produced from a spinneret plate having a high orifice density. It will be understood that the expression "high orifice density" means that a spinning plate having a relatively small diameter will have a large number of spinning orifices therein. For example, a plate with a diameter on the order of 60 millimeters will have from 48 to 96 or more spinning orifices provided therein, with each orifice having a diameter ranging from about 200 to 300$\mu$.

More particularly, it has been found that spinneret plates with the spinning orifices or holes arranged in patterns having one or more air channels or lanes extending across the spinneret plate will reduce the unevenness of the denier in the filaments substantially.

Thus, this invention is directed to an apparatus for melt spinning of synthetic yarns including a spinneret assembly means for extruding molten polymeric material through spinning orifices in a plate and a blow box assembly for directing a cooling gas transversely across the filaments which are extruded vertically down from the spinning plate, the spinning plate having at least two groups of a plurality of spinning orifices which are spaced apart, with the groups being arranged to provide at least one open lane or channel between adjacent groups. The lane or channel has a length that is sufficient to extend across the portion of the plate having the orifices provided therein and has a width that is greater than the distance between adjacent spinning orifices within each of the groups.

Furthermore, it has been found that the groups of orifices are arranged so that the open lane or channel is preferably arranged parallel to the direction of flow of the cooling gas through the filaments and across the spinneret plate. This arrangement promotes the penetration of the cooling gas between and around the groups of filaments which extend vertically downward from the spinneret plate. Consequently, the denier of the filament clusters or bundles are more even along the length of yarn. It will also be appreciated that it is advantageous to arrange the orifices in each group in rows which also extend parallel to the direction of flow of the cooling gas, and that the number of open lanes or channels provided on the spinneret plate may be varied. Generally, from 1 to 5 channels are provided, with each channel being preferably parallel to the other.

In accordance with this invention, a group of orifices comprises at least two rows of spaced orifices, preferably the rows are parallel. The orifices are usually spaced apart at a distance of at least 1 to 2 mm. in order to ensure sufficient space between filaments exiting the spinneret in the resulting yarn or filament cluster.

The shape of the orifices through which the polymer melt is extruded may be varied and includes any shape of orifice. Circular and odd-shaped orifices such as those used to produce a multilobal yarn, for example a trilobal yarn, may be used in accordance with the present invention. The diameter of circular spinning orifices may vary from about 175 to 450 microns.

This invention is particularly directed to an apparatus for producing multi-filament yarns having a high filament count and a low denier per filament count on existing melt spinning apparatus which is conventionally used to produce yarns with lower filament counts. In such apparatus, the spinneret assemblies will have a spinning plate with a diameter of from 20 to 200 mm. For example, a conventional spinning plate may have a diameter of 40 mm. and contain 24 orifices or holes arranged in a cluster with the holes being spaced in a pre-selected distance apart in rows which are spaced at the same or another pre-selected distance apart. It will be appreciated that in such known spinneret assemblies the row of holes for forming a cluster may be spaced at distances on the order of 5 mm. and the orifices in each row may be spaced at distances on the order of 7 mm., and therefore the density of the filament cluster or bundle vertically extending down from the plate is relatively low. In such situations, the cooling gas usually has ample space around each of the filaments to penetrate into the filament cluster and promote uniform cooling of the filaments. However, when the number of orifices or holes is substantially increased the density of the filaments within the cluster rapidly increases and in such cases the instability of the thread line as widened by its lateral motion is increased. For example, it has been found that when a relatively high filament count is required in a low denier yarn, such as in the production of polyester yarns having 96 filaments and a denier of 150, the degree of unevenness of the filaments within the yarn is on the order of from 10 to 12%. Advantageously, in accordance with the present invention this degree of unevenness is reduced to be on the order of from 4 to 6% while still maintaining the same filament count and the same low denier and using the same size spinning plate. For example, a spinning plate in accordance with the present invention may have a diameter of 60 mm. and can be provided with from 48 to 96 orifices to produce yarns having a total denier of from 70 to 150.

As heretofore noted, the width of the open lanes or channels, that is the distance between adjacent groups of orifices in accordance with this invention, is significantly larger than the distance between adjacent rows of orifices within a group. For example, in a 60 mm. spinning plate an open lane will have a width in the range of from 1.5 to 10 times the spacing between the rows within a group. This spacing may be defined by the following, that is $$1.5 \leqq W_l/W_r \leqq 10.0$$

wherein $W_l$ is the width of a lane and $W_r$ is the distance between rows of orifices.

The quantity $W_l/W_r$ can be referred to as a "normalized lane width".

In accordance with the present invention the normalized lane width has an effective range which will be expected to change with the length of the lane, that is the centerline distance from the entrance end to the exit end of the lane extending across the spinneret plate. In general, the longer the lane the effective range of the normalized lane width will increase; whereas the shorter the lane, the effective range of the normalized lane width will decrease.

This invention is also directed to a process for producing yarns which comprise extruding a molten polymeric material through a spinning plate having a plurality of orifices to form a plurality of filaments, arranging the filaments into a plurality of groups by providing the spinning plate with at least one open lane that is free of orifices and that extends across the spinning plate between groups of orifices corresponding to the groups of filaments, the orifices being arranged in parallel rows within each group and the lane having a width greater than the distance between adjacent rows, and passing a cooling gas transversely across the filaments, in a direction parallel to a center line of the lane to promote uniform cooling of the filaments.

The process and apparatus of this invention will be better understood from the following detailed description taken in connection with the accompanying drawing in which.

Figure 1:
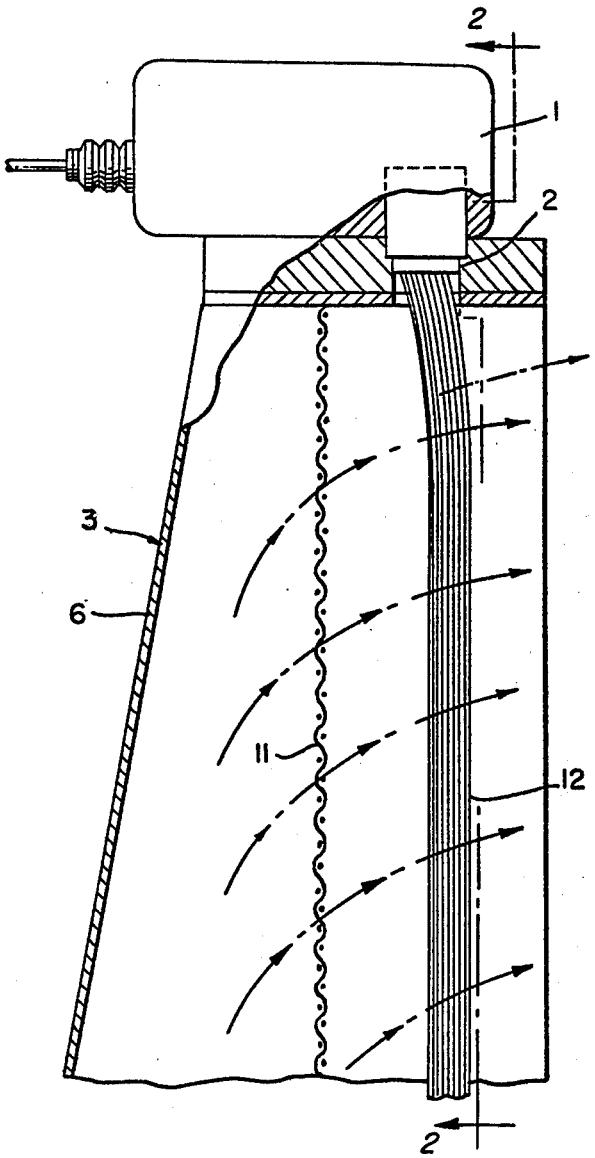
FIG. 1 is a side elevational view of the melt spinning apparatus of the invention.

In FIG. 1 reference numeral 1 denotes a spinneret assembly from which a molten polymeric material is extruded in a known manner through orifices in a pair of spinning plates 2. A blow box assembly is indicated generally by reference numeral 3 and is divided into compartments 4 and 5, an inclined end wall 6 connects sidewalls 8 and 9 of the compartments 4 and 5 and an intermediate wall 10 extends parallel to the sidewalls 8 and 9 and separates the compartments 4 and 5. This wall is secured with end wall 6. A gas filter in the form of a wire screen 11 is provided in each compartments 4 and 5 upstream of the spinning plate and serves to quiet the cooling gas before it passes over the filaments 12 extruded downwardly from the spinning plates.

The cooling gas such as air is supplied to each of the compartments 4 and 5 from the bottom thereof. This air is supplied under a slight pressure in order that it may have the required flow rate of from about 80 to greater than 250 cubic ft./min. The filter 11 diffuses the air as it enters each of the compartments and thereby tends to reduce turbulence. It will be understood that in accordance with conventional procedures the air cools the yarn formed during the spinning operation and carries any vaporous materials out of each of the compartments into the atmosphere or into a collecting duct.

Figure 2:
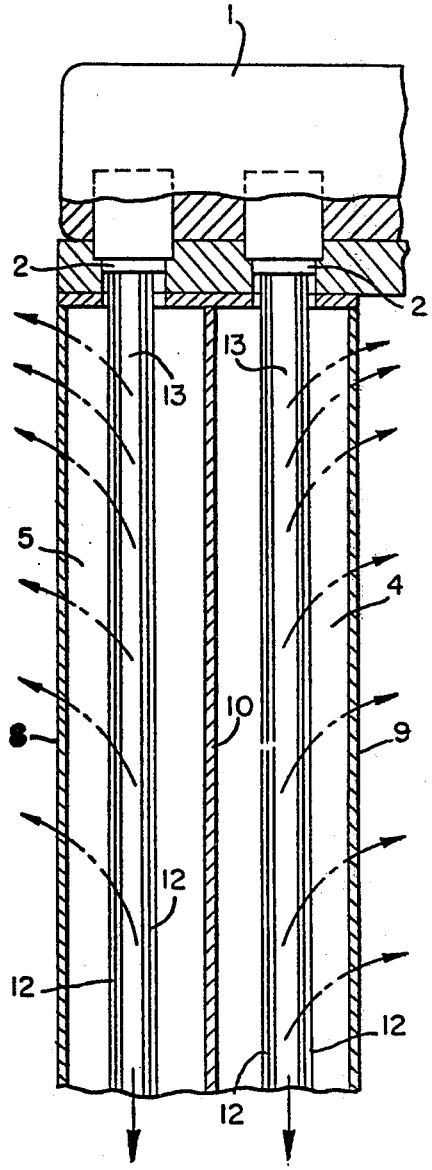
FIG. 2 is a front elevational view partly in section of the apparatus of FIG. 1.

The filaments extruded from plates 2 have been shown by a number of lines in FIGS. 1 and 2, it being understood that a larger number of filaments are being formed. Also, one open lane 13 is shown between two adjacent groups of filaments, with the width of the lane being enlarged to facilitate illustration.

Figure 3:
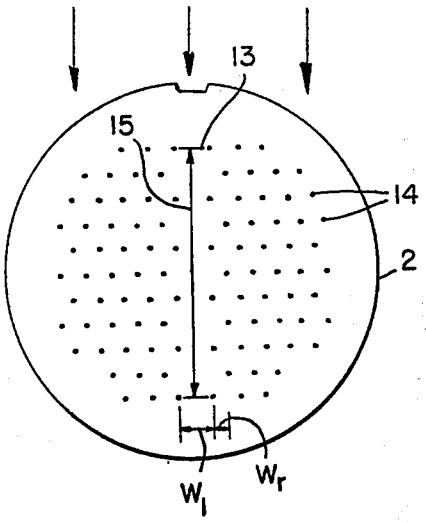
FIG. 3 through FIG. 7 are bottom views of a spinning plate having at least one open lane or channel according to this invention.
Figure 4:
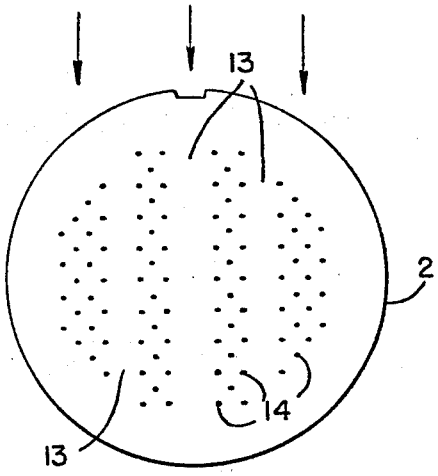

In FIG. 3 there is illustrated an embodiment of a spinning plate 2 having 96 orifices and one open lane 13 provided between the two groups of orifices 14. FIGS.

4 and 5 respectively show spinning plates having 96 orifices and having three and five open lanes that extend parallel to each other and parallel to the rows of orifices in each group of orifices.

Figure 5:
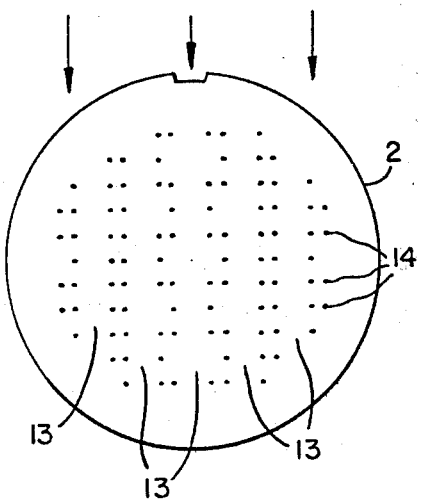
Figure 6:
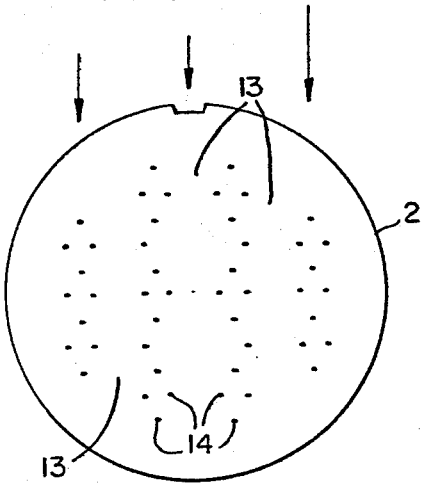
Figure 7:
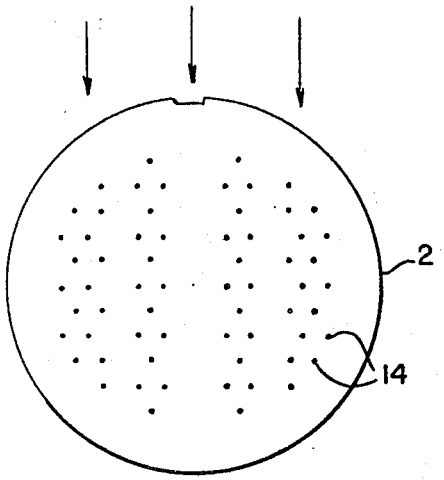
Figure 8:
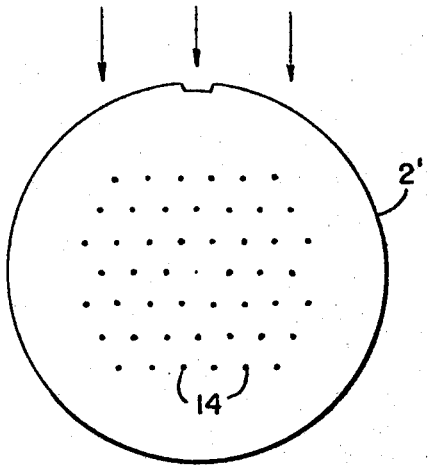
FIGS. 8, 9 and 10 are bottom views of spinning plates having orifices arranged in a pattern wherein the orifices are grouped together.

In the spinning plate in FIG. 6 there are 48 orifices arranged to provide three open lanes; whereas FIG. 7 shows a 64 orifice plate with three open lanes. It will be understood that the arrows at the top of each of the FIGS. 3 to 10 represent the direction of flow of the cooling gas across the spinning plates.

Also in FIG. 3, the length of the open lane is designated by center line 15 and the width by the distance $W_1$, with the spacing between adjacent rows of orifices being the distance $W_r$.

It will be understood that the orifices 12 are conventional orifices and in the embodiments shown and in the examples that follow each orifice has a wide cylindrical portion extending from the upper surface of the plate in contact with the molten polymer, an intermediate conically tapered portion and a narrow cylindrical portion that extends to the bottom surface of the plate.

Also in the process of this invention various polymeric materials conventionally used to produce filaments by melt spinning may be employed; for example polyamides, polyesters, polyethers, polyacetals, polyolefins, vinyl polymers and the like.

Furthermore, the extrusion temperature and the extrusion rates of the molten polymeric material are conventional and are determined by the particular polymer being used and the deniers of the desired yarn products.

The winding speeds used to take up the filaments may vary from 600 to 2,000 meters per minute (mpm) or more with drawing speeds of from 500 to 1,000 mpm.

This invention will be further illustrated by the following examples wherein polyester yarns are produced with deniers ranging from about 70 to about 150.

EXAMPLE 1

Granular polyethylene terephthalate having an intrinsic viscosity of 0.64 and a moisture content of less than 0.01% by weight was melted and spun into yarn using an electrically heated extruder at 290° C. with a pumpblock heated by a gaseous medium at 295° C. The molten polymer was forced at 2,300 psi through the 96 orifices in a 60 mm. diameter spinneret similar to that shown in FIG. 4 having three open lanes. The orifices had a diameter of 200 microns and were spaced into four groups. The orifices within each group were arranged into rows parallel to the direction of air flow. The distance between the outer row of an inner group of orifices and the inner row of the adjacent outer group of orifices was 6.0 mm. The distance between the inner row of an inner group of orifices and the inner row of the other inner group of orifices was 8 mm. Adjacent rows of orifices within a group were spaced 2.0 mm. apart. Within a row, the orifices were spaced 5.0 mm., apart. Within a group, orifices in a given row were displaced relative to the orifices in an adjacent row by half the distance separating the orifices within a row.

During the spinning, the lower surface of the spinning plate had a temperature of 276° C. Positioned below the spinneret plate was a conventional blow box assembly. Air at room temperature was passed through the blow box rear chamber. The air moved through the blow box transversely to the molten filaments falling downwardly through the same and flowed parallel to the rows of orifices. The velocity of the air was 34 centimeters per second and the zone through which the filaments were exposed to the air was 100 centimeters in length. The quantity of the air was 2275 liters per minute. The resulting threads were wound at 1400 mpm and subsequently stretched to a total denier of 149.5 with an average filament denier of 1.56. The denier evenness was 6.2%, as determined by a standard test for evenness of textile strands, ASTMD 1425-67 using a Uster tester (Type GGP-C10).

EXAMPLE 2

Figure 10:
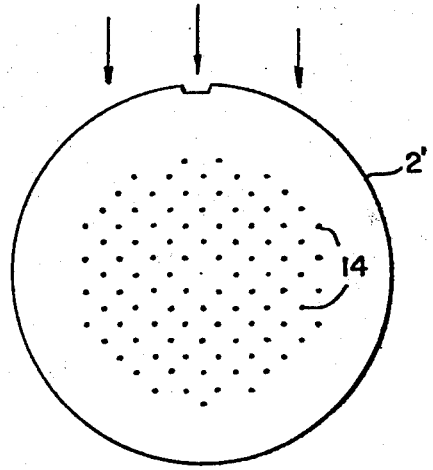

Additional polymer was spun in an identical manner to Example 1 except a conventional spinning plate of the same diameter was used in which the orifices were all arranged into a single group positioned on the corners of 3.7 mm. squares as shown in FIG. 10. The resultant threads had a denier evenness of 11.0%.

EXAMPLES 3 AND 4

Additional polyester polymer was spun under similar conditions using a spinning plate having one lane as shown in FIG. 1 or two lanes (not shown) with 96 orifices arranged in two or three groups. Each orifice had a diameter of 200$\mu$. With the single lane the resultant threads had a denier evenness of from 7–8%; whereas with the two lanes the threads had a denier evenness of from 5% to 7.5%.

EXAMPLE 5

Granular polyethylene terephthalate having an intrinsic viscosity of 0.64 and a moisture content of less than 0.01% by weight was melted and spun into yarn using electrically heated extruder at 290° C. with a pumpblock heated by a gaseous medium at 295° C. The molten polymer was forced through the 96 orifices in a spinning plate having a diameter of 60 mm. and the orifices arranged as shown in FIG. 5. The orifices had a diameter of 200 microns and were spaced into six groups. The orifices within each group of orifices were arranged into rows parallel to the air flow. The distance between the rows of adjacent groups of orifices was 6.0 mm. Adjacent rows of orifices within a group of orifices were spaced 2.0 mm. apart.

During the spinning, the lower surface of the spinning plate had a temperature of 276° C. Positioned below the spinneret plate was a blow box assembly. Air at room temperature was passed through the blow box rear chamber. The air moved through the blow box transversely to the molten filaments falling downwardly through the same and flowed parallel to the rows of orifices. The quantity of the air was 3450 liters per minute. The resulting threads were wound at 1000 mpm and subsequently drawn into a yarn having an average filament denier of 1.56. The denier evenness was 6%.

EXAMPLE 6

Additional polymer was spun in an identical manner to Example 5 with a 60 mm. diameter plate except the orifices were all arranged into a single group of uniformly spaced orifices positioned on the corners of a 3.7 mm. square (FIG. 10). The resultant threads had a denier evenness of 8.9%.

EXAMPLE 7

Granular polyethylene terephthalate having an intrinsic viscosity of 0.64 and a moisture content of less than 0.01% by weight was melted and spun into yarn using electrically heated extruder at 290° C. with a pumpblock heated by a gaseous medium at 295° C. The molten polymer was forced through the 64 orifices in the spinning plate having a diameter of 60 mm. and the orifices arranged as shown in FIG. 7. The orifices had a diameter of 200 microns and were spaced into four groups. The orifices within each group of orifices were arranged into rows parallel to the air flow. The distance between the rows of adjacent groups of orifices was 6.0 mm.

Adjacent rows of orifices within a group of orifices were spaced 2.0 mm. apart. Within a row, the orifices were spaced 8.0 mm., apart. Within a group of orifices, orifices in a given row were displaced relative to the orifices in an adjacent row by half the distance separating the orifices within a row. During the spinning, the lower surface of the spinning plate had a temperature of 276° C. Positioned below the spinneret plate was a blow box assembly. Air at room temperature was passed through the blow box rear chamber and filter composed of gauze. The air moved through the blow box transversely to the molten filaments falling downwardly through the same and flowed parallel to the rows of orifices. The velocity of the air was 34 centimeters per second and the zone through which the filaments were exposed to the air was 100 centimeters in length. The quantity of the air was 2275 liters per minute.

The resulting threads were wound and subsequently drawn to form a yarn having an average filament denier of 1.56. The denier evenness was 5.5%.

EXAMPLE 8

Figure 9:
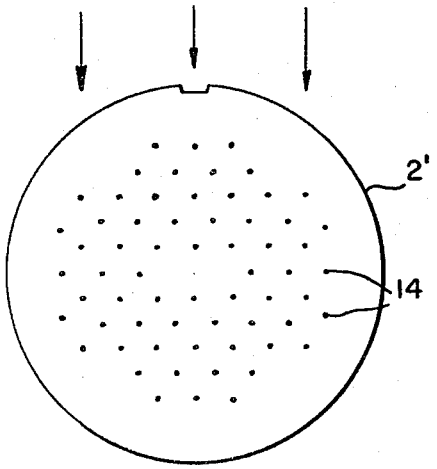

Additional polymer was spun in an identical manner to Example 7 through a 60 mm. plate except the orifices were all arranged into a single group as shown in FIG. 9. The resultant threads had a denier evenness of 6.4%.

It will be appreciated that with a spinning plate of the same diameter the provision of a smaller number of spinning orifices allows the spacing between adjacent orifices to increase thereby promoting more uniformity in the denier of the filament bundle.

EXAMPLE 9

Additional polymer was spun in a manner similar to Example 8, except that spinning with 48 orifices (200$\mu$ diameter) were used, one having three open lanes (i.e. 4 groups of orifices) and the other having the normal or conventional single group of orifices. The threads obtained from the three lane spinning plate had a total denier of 70 and an evenness of 4–5% and the thread from the other plate had the same denier and an evenness of 6%.

It will be appreciated that the spinning plates useful for the purpose of this invention generally will have a circular configuration similar to those conventionally used in the melt spinning of synthetic yarns. However, other configurations are equally suitable for the purposes of this invention.

Also, it will be understood from the description of the invention and the illustration of the spinning plates provided in FIGS. 3 through 10 that the outermost spinning orifices in each group are spaced from the periphery of the spinning plate at distances varying from 5 to 10 mm. Accordingly, the operative or effective area of the plate wherein spinning orifices are provided is smaller than the area of the spinning plate. Consequently, the density or number of spinning orifices per unit area is determined by the effective or operative area of the plate. Generally, in accordance with this invention the number of spinning orifices per unit area will be greater than 1.4 holes per $cm^2$. For example an effective diameter of a plate having a diameter of 60 mm. may be 50 mm.

It should also be recognized that the density of spinning orifices and the arrangement of the open lanes or channels determines the relative spacing between the filaments which are extruded downwardly from the plate. It has been determined that the direction of the flow of cooling gas through the filaments is preferably parallel to the open lanes or channels. However, the cooling gas may enter at an angle to the lane direction with the evenness of the filaments decreasing as the angle increases. For this reason it is preferred, as previously noted, that the cooling gas enter directly into the channels or lanes.

It has also been found that in accordance with the present invention that in the production of filaments having a non-circular cross-section, the modification ratio can be increased by using a spinning plate having at least one open lane or channel arranged in the manner disclosed herein. Apparently, the improved uniformity of cooling enhances the desired level of cross-section definition which is measured by the modification ratio.

What is claimed is:

1. A process for melt spinning of polymers into synthetic yarns with a spinneret assembly including a spinning plate which comprises extruding a molten polymer downwardly through a spinning plate having a plurality of spinning orifices to form filaments of said polymer that extend vertically downwardly from said plate, arranging said filaments into a plurality of groups by providing the spinning plate with at least one open lane that is free of orifices and that extends across the operative area of the plate between the groups of orifices corresponding to the groups of filaments, said orifices being arranged in parallel rows in each group and said lane having a width wider than the distance between adjacent orifices within each of said groups, with the spinning plate having an average of from 2 to 10 orifices per $(10\ mm.)^2$ of the operative area, and passing a cooling gas transversely between and through the groups of filaments in a direction parallel to a centerline of the lane whereby said filaments provide a yarn of a high filament count and of a low denier per filament count that exhibits a reduced degree of denier uneveness as compared with a yarn with the same filament count and denier produced by a conventional spinning plate having the same operative area.

2. The process of claim 1, wherein said spinning plate is provided with a plurality of open lanes that are free of orifices, and that extend parallel across the operative area of the plate between the groups of orifices corresponding to the groups of filaments, and the cooling gas is passed transversely between and through the groups of filaments in a direction parallel to the centerlines of the parallel lanes.

3. The process of claim 1, wherein said polymers are selected from the group consisting of polyamides, polyesters, polyethers, polyacetals, and polyolefins.

4. The process of claim 1, wherein the molten polymer is a polyester.

5. The process of claim 1, wherein the molten polymer is polyethylene terephthalate.

6. The process of claim 1, wherein the spinning plate has a diameter of 60 mm, and is provided with from 48 to 96 orifices to produce a yarn having a total denier of from 70 to 150.

7. The process of claim 1, wherein the cooling gas is air at room temperature.

8. The process of claim 1, wherein said filaments are arranged in linear rows that are parallel to each other and to the direction of flow of the cooling gas through the groups of filaments and across said spinning plate.

9. The process of claim 8, wherein said spinning plate provides a high density of filaments within each group of filaments.

10. The process of claim 1, wherein the operative area of said spinning plate is the area having orifices provided therein.

11. The process of claim 10, wherein the orifices and the resulting filaments are spaced apart by a distance of at least 1 to 2 mm.

12. The process of claim 11, wherein the lane has a width that is from 1.5 to 10 times that of the distance between adjacent rows of filaments.

13. The process of claim 12, wherein the spinning plate has a diameter of from 20 to 200 mm.

14. The process of claim 1, wherein the spinning orifices are circular and have a diameter ranging from 175 to 450$\mu$.

15. The process of claim 1, wherein the spinning orifices have a non-circular configuration to define filaments that have a multi-lobal cross-section.

* * * * *